United States Patent [19]

Nakayama et al.

[11] Patent Number: 4,712,908

[45] Date of Patent: Dec. 15, 1987

[54] IMAGE FORMING APPARATUS

[75] Inventors: Tomobumi Nakayama; Toshihiko Mori, both of Tokyo; Masayuki Hirose, Yokohama; Toru Ohbuchi, Yokohama; Masanori Miyata, Yokohama; Shinichi Nakamura; Takeshi Honjo, both of Kawasaki, all of Japan

[73] Assignee: Canon Kabushiki Kaisha, Tokyo, Japan

[21] Appl. No.: 908,254

[22] Filed: Sep. 17, 1986

[30] Foreign Application Priority Data

Sep. 19, 1985 [JP] Japan ..... 60-207022

[51] Int. Cl.[4] ..... G03G 15/00

[52] U.S. Cl. ..... 355/14 SH; 355/14 CU; 355/3 SH; 355/55

[58] Field of Search ..... 355/14 SH, 14 CU, 14 R, 355/55–57, 3 SH

[56] References Cited

U.S. PATENT DOCUMENTS 4,455,081 6/1984 Yoshimura et al. ..... 35/14 SH

*Primary Examiner*—R. L. Moses

*Attorney, Agent, or Firm*—Fitzpatrick, Cella, Harper & Scinto

[57] ABSTRACT

An image forming apparatus is disclosed which comprises an image forming member for forming a plurality of images onto one sheet, a setting member for setting the number of sheets to be formed with images and a control member for controlling the image forming member in order to execute formation of the images for the number of sheets which can be loaded in a tray. The image forming member has the tray for temporarily loading the sheet on which a part of the images has been formed and further forms another part of the images onto the sheet loaded in the tray, when the number of sheets which is set by the setting member is larger than the number of sheets which can be loaded in the tray a plurality of the above operations are repeated.

15 Claims, 8 Drawing Figures

IMAGE FORMING APPARATUS

BACKGROUND OF THE INVENTION

1. Field of the Invention

The present invention relates to an image forming apparatus having a middle tray to temporarily store a sheet onto which an image was formed.

2. Related Background Art

In apparatus having a two-sided copy function an overlay copy function, when the two-sided or overlay copy is performed, the image on the first sheet of original is copied on a sheet and thereafter, this sheet is temporarily stored to the middle tray in the apparatus. However, the number of sheets which can be stored in the middle tray is limited and has no relation to the maximum number of continuous copies of the apparatus itself. Therefore, in execution of the two-sided copy or overlay copy function, it is impossible to continuously perform the copies above the number of sheets which can be stored to the middle tray, so that there is the drawback that the inherent performance of the apparatus cannot be effectively used.

In addition, in the case of performing two-sided copy from a plurality of originals of different sizes by such apparatus, if the image of the second original is copied onto the paper on which the image of the first original has been copied, the image of the second original may be lacking.

On the other hand, in such apparatus, there is considered the function of detecting the original size while feeding the original by the original feeding apparatus and to automatically select the cassette in which the papers of the optimum size were enclosed in accordance with the detected original size. However, in this function, it takes time until copying is started because the copy paper can be fed only after the original size was detected, so that a long time is required to copy a large quantity of originals. In particular, in the case of the originals of the same size, time is expended uselessly.

Further, when performing two-sided copy from one-side of an original, no problem will be caused if the number of originals is even. However, in the case of copying an odd number of, for example, three originals in this kind of apparatus, if they are copied from the third page, the second and third pages are formed on the front and back surfaces of a sheet of paper as shown in FIG. 7 and the first page is combined with the blank page, so that the resultant copies become unnatural.

To prevent such a situation, there is considered the method whereby the number of originals is previously counted to determine whether it is an odd number or an even number, and when it is an odd number, only the last page is copied in the one-sided copy mode and the remaining pages are copied in the two-sided copy mode. However, this method has the drawback that it takes a long time until the copy operation is started since the number of originals must be counted.

In particular, if a few originals are copied, the operator often waits for the end of copy at a location near the copying apparatus; therefore, in many cases, the operator considers the time for the counting operation as an annoying time.

SUMMARY OF THE INVENTION

It is an object of the present invention to provide an image forming apparatus which can eliminate the foregoing drawbacks.

Another object of the invention is to improve the image forming apparatus.

Still another object of the invention is to provide an image forming apparatus in which a number of papers in excess of the number of papers which can be stored to the middle tray can be continuously copied by a single input operation.

Still another object of the invention is to provide an image forming apparatus in which when a plurality of original images are formed on one sheet, the original images can be formed on the correct surfaces of the sheet irrespective of the number of originals.

Still another object of the invention is to provide an image forming apparatus which can also efficiently set the conditions to form the images even in the case where originals of different sizes are set to the feeding apparatus or where only the originals of the same size are set to the feeding apparatus.

Still another object of the invention is to provide an image forming apparatus in which when a plurality of original images are formed on one sheet, the lack of images can be prevented even if the images of different sizes are mixed.

The above and other objects and features of the present invention will become apparent from the following detailed description and the appended claims with reference to the accompanying drawings.

DETAILED DESCRIPTION OF PREFERRED EMBODIMENTS

An embodiment of the present invention will now be described in detail hereinbelow with reference to the drawings.

Figure 1:
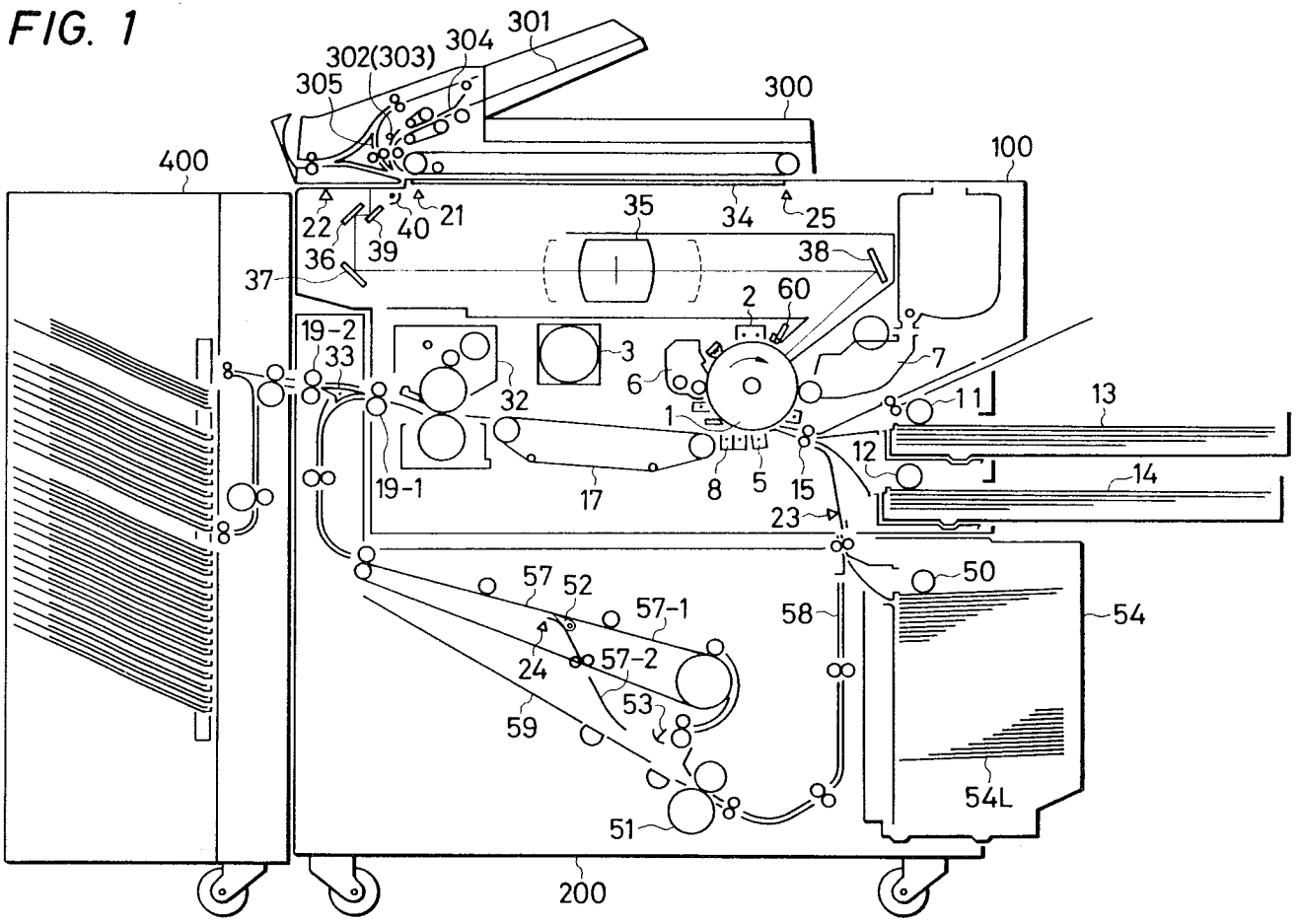
FIG 1. is a cross sectional view of a copying apparatus to which the present invention can be applied.

FIG. 1 is a constitutional cross sectional view illustrating the whole part of an embodiment of an image forming apparatus to which the invention is applied.

In the diagram, the surface of a drum 1 consists of a seamless photo sensitive material using a photoconductive material or a conductive material. The drum 1 is rotatably axially supported and starts rotating in the direction indicated by an arrow by a main motor 3. The main motor 3 is made operative by depressing a copy start key. After completion of the prerotation and potential control processes (preprocesses) of the drum 1, an original put on an original plate glass 34 is illuminated by an illumination lamp 40 which is constituted integrally with a first scan mirror 39. The reflected lights pass through the first mirror 39, a second mirror 36, a third mirror 37, a lens 35, and a fourth mirror 38 and are formed as an image on the drum 1.

The drum 1 is corona-charged by a high voltage unit 2. Thereafter, the image illuminated by the exposing lamp 60 is slit-exposed, so that an electrostatic latent image is formed on the drum 1 by a well-known method.

Next, the latent image on the drum 1 is developed by a developing roller of a developing device 7, so that a visible toner image is formed. This toner image is transferred by a transfer charging device 5.

A transfer paper in an upper cassette 13 or lower cassette 14 is fed into the main body of the copying apparatus by a paper feed roller 11 or 12. The transfer paper is then sent toward the photo sensitive drum 1 by a resist roller 15 at an accurate timing until the edge of the latent image coincides with the edge of the transfer paper. Thereafter, the toner image on the drum 1 is transferred onto the transfer paper when it passed through the space between the transfer charging device 5 and the drum 1.

After completion of the transfer of the toner image, the transfer paper is separated from the drum 1 by a separation charging device 8 and led to a fixing device 32 by a conveying belt 17. The transfer paper is applied with a pressure and heated, so that it is fixed. Subsequently, the fixed transfer paper is delivered out of the apparatus by paper output rollers 19-1 and 19-2.

The drum 1 after completion of the transfer is further rotated and the surface thereof is cleaned by a cleaning apparatus 6 consisting of a cleaning roller and an elastic blade.

A pedestal 200 can be detached from a main body 100 and has a deck 54 capable of enclosing two thousand transfer papers and a middle tray 59 for use in the two-sided copy mode and in the overlay copy mode. A lifter 54L of the deck 54 rises in accordance with a quantity of transfer papers such that the transfer papers can always come into contact with a paper feed roller 50.

In the first side copy in the two-sided or overlay copy mode, a paper out flapper 33 of the main body 100 is lifted up to store the copied transfer paper to the middle tray 59 through a conveying path 57 of the pedestal 200. In this case, an overlay flapper 52 is dropped in the two-sided copy mode, while the overlay flapper 52 is lifted up in the overlay copy mode. The middle tray 59 can store up to ninety-nine transfer papers. The enclosed transfer papers are depressed by a middle tray weight 53.

Next, when the back side is copied or the second side in the overlay copy mode is copied, the transfer papers enclosed in the middle tray 59 are sequentially led to the resist roller 15 of the main body 100 through a path 58 one by one from the bottom by the actions of a paper feed roller 51 and the weight 53.

Reference numeral 300 denotes a recirculating original feeding apparatus (RDF); 301 is a carrying tray to set the original; and 302 and 303 original size sensors which are arranged at predetermined intervals in the direction perpendicular to the paper of the diagram. The width of original can be determined by checking whether the original has been detected by both sensors 302 and 303 or by only the sensor 303 (it is assumed that the sensor 303 is located on the rear side of the paper). By increasing the number of sensors, the width of original can be more accurately decided. On the other hand, the length of original can be determined by the time interval when the original is being detected by the sensor 303 (302).

In the RDF 300, the original carried from the carrying tray 301 to the exposing surface through a sheet path 304 is conveyed through a sheet path 305, so that it can be again stacked onto the tray 301.

The operation of the RDF is disclosed in detail in Japanese Patent Application No. 206619/1984, which has been filed by the present inventors; therefore, it is omitted in this specification.

Further, a sorter 400 sorts the copies which were discharged out of the main body.

Figure 2A:
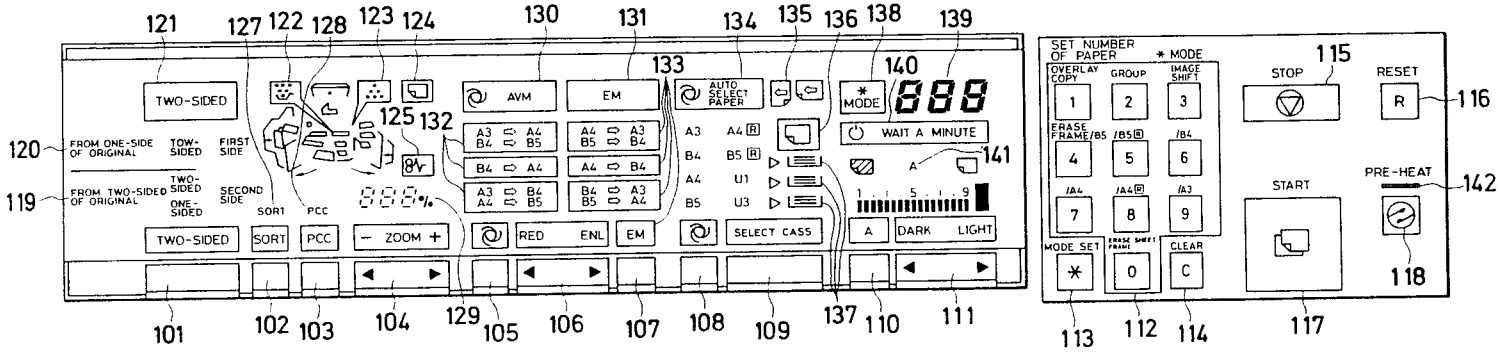
FIG. 2 (A and B) is a diagram showing an operating section of the copying apparatus shown in FIG. 1.
Figure 2B:
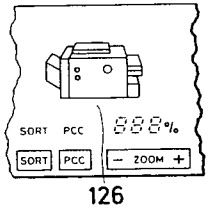

FIGS. 2A and 2B are plan views showing the whole operating section of the main body 100.

A two-sided key 101 is pressed to obtain the two-sided copy from one-side of original, or the two-sided copy from two-sides of original, or the one-sided copy from two-sides of original.

A sort key 102 is selected in the standard mode when the sorter 400 is connected. The sort key 102 is pressed to cancel the standard mode or to set the sort mode.

A serial page copy key 103 is pressed to respectively copy the left and right pages of the original on separate papers.

A zoom key 104 is pressed to designate an arbitrary magnification at a pitch of 1% within a range of 64 to 142%.

An automatic magnification key 105 is pressed to automatically reduce or enlarge the original image in accordance with the size of the copy paper designated.

A standard size magnification key 106 is pressed to designate the reduction or enlargement of the standard size.

An equal magnification key 107 is pressed to copy at an equal magnification (namely, the same original size).

An automatic paper selection key 108 is pressed to automatically select the optimum copy paper in accordance with the original size and the designated variable magnification.

A cassette selection key 109 is pressed to select either one of the upper cassette, middle cassette, and lower paper deck.

An AE key 110 is pressed to automatically control the copy concentration in accordance with the concentration of original or to cancel the AE mode and manually change over the copy concentration.

A copy concentration key 111 is pressed to manually control the copy concentration.

A ten-key 112 is pressed to set the number of copies and also used to set the * (asterisk) mode.

An * (asterisk) mode setting 113 is pressed to set the overlay copy, group (collation), image shift, erasure of the original frame, or erasure of the sheet frame.

A clear key 114 is pressed to cancel the set number of copies and also used to cancel the * (asterisk) mode.

A stop key 115 is pressed to interrupt the continuous copy mode. After completion of the copy at the time of depression of the stop key 115, the copying operation is stopped.

An all reset key 116 is pressed to return the operating mode to the standard mode.

A copy start key 117 is pressed to start the copy.

A preheating key 118 is pressed to set the copying apparatus into the preheating state or to cancel the preheating state. The preheating key 118 is also pressed to return the operating mode to the standard mode from the automatic shut-off state.

A two-sided copy indicator 119 is lit up when either the two-sided copy from two-sides of original or the two-sided copy from one-side of original was selected.

A one-sided copy indicator 120 is lit up when the one-sided copy from two-sides of original was selected.

A two-sided mode indicator 121 is lit up when the two-sided copy mode was selected.

A toner collection indicator 122 is lit up when the collecting vessel was filled with the used toner. No copy key is accepted while the indicator 122 is lighting.

A toner supply indicator 123 is lit up when the toner lacks. No copy key is accepted while the indicator 123 is lighting.

An original left indicator 124 is lit up when the original was left on the original plate glass for a time interval greater than a predetermined time after the copy had been finished.

A paper feed indicator 125 is lit up when a paper jam occurs.

In FIG. 2B, a simulation monitor display 126 indicates the flow of paper in the main body. The content as shown in FIG. 2B is displayed in the ordinary state. When the paper jam occurs, a paper jam check indicator is lit up.

A sort indicator 127 is lit up when the sort mode was selected and when the copying apparatus is in the sort mode.

A serial page copy indicator (PCC) 128 is lit up when the serial page copy mode was selected.

A magnification indicator 129 displays the set magnification by percentage (%).

An automatic variable magnfication indicator (AVM) 130 is lit up when the automatic variable magnification mode was selected.

An equal magnfication indicator (EM) 131 is lit up when the equal magnification copy mode was selected.

A standard size reduction indicator 132 is lit up when the standard size reduction mode was selected.

A standard size enlargement indicator 133 is lit up when the standard size enlargment mode was selected.

An automatic paper selection indicator 134 is lit up when the automatic paper selection mode was selected.

An original direction indicator 135 displays the (longitudinal or lateral) setting direction of the original.

A paper supply indicator 136 is lit up when no paper is left in the selected cassette deck, or when the selected cassette is not set in the main body, or when the paper cover of the deck is open.

A use cassette indicator 137 displays the selected one of the upper, middle, and lower cassettes and decks.

An * (asterisk) mode indicator 138 is lit up when the * (asterisk) mode was set.

A copy quantity indicator 139 displays the number of copies or the self diagnostic code.

A wait indicator 140 is lit up when the main body is being warmed up. When. the wait indicator 140 is lit, copying cannot be performed.

An AE indicator 141 is lit up when the AE (automatic concentration control) mode was selected.

A preheating indicator 142 is lit up when the copying apparatus is preheated. The preheating indicator 142 flickers when the apparatus is in the automatic shut-off state. When the RDF is used, in the standard mode, the number of copy is one, the concentration AE mode is selected, the papers are automatically selected, the equal magnification is set, and the one-sided copy from one-side of original is set. On the contrary, when the RDF is not used, the number of copies is one, the concentration manual setting mode is selected, the equal magnification is set, and the one-sided copy from one-side of original is set. The difference between the RDF in the operative state and the RDF in the inoperative state is determined by checking whether the original has been set to the RDF or not.

The control of the operation of the copying apparatus shown in FIG. 1 according to the invention will now be described.

Figure 3:
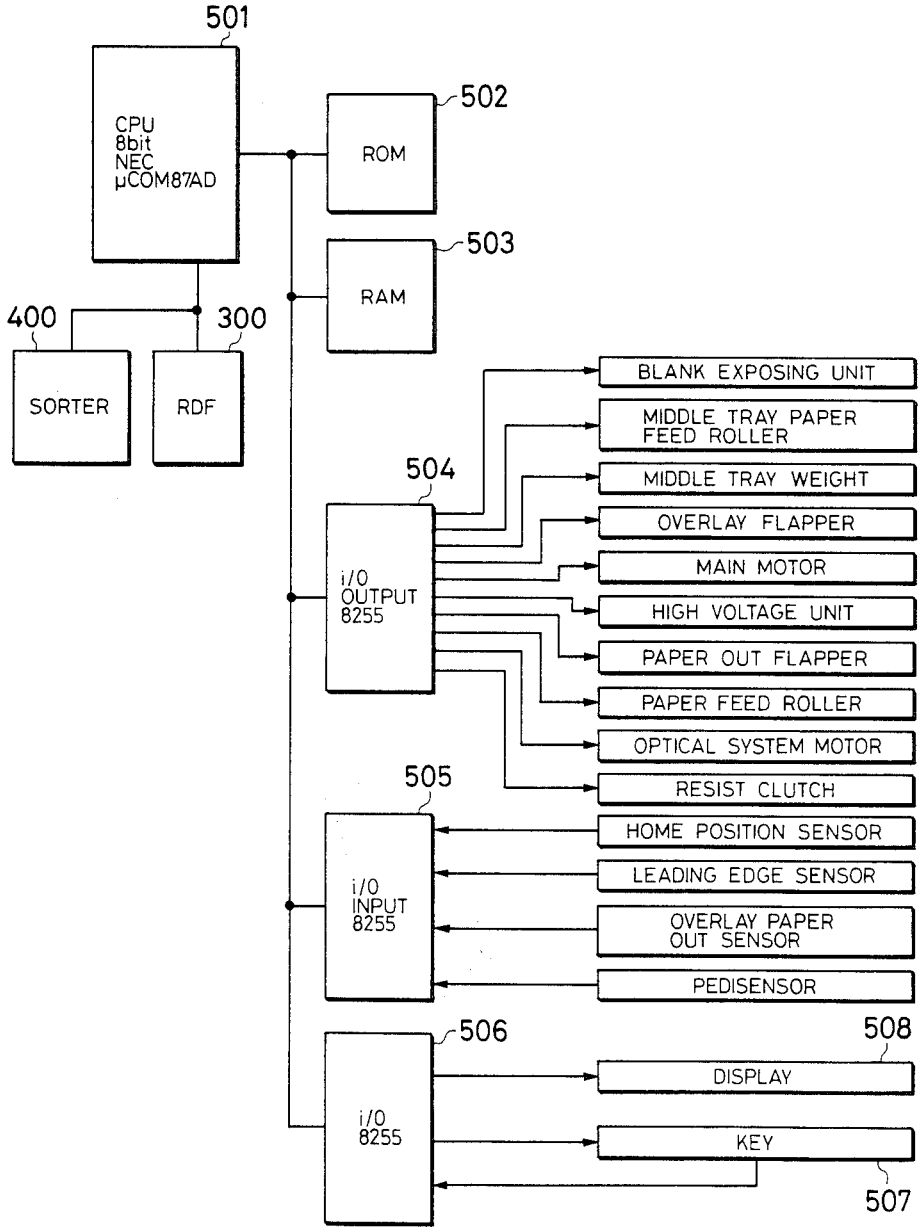
FIG. 3 is a control block diagram of the copying apparatus shown in FIG. 1.

FIG. 3 is a circuit block diagram to execute the invention. In the diagram, a central processing unit (CPU) 501 is constituted by, for example, μCOM 87AD manufactured by Nippon Electric Co., Ltd. Reference numeral 502 denotes an ROM in which the control programs are stored. The CPU 501 controls the copying apparatus in accordance with the control programs. Numeral 503 indicates an RAM as a main storage device; 504 is an interface to output control signals to loads such as the main motor and the like; 505 an interface to receive input signals from a leading edge sensor and the like; and 506 an interface to control the inputs and outputs of a key 507 and a display 508. The display 508 corresponds to each of the indicators shown in FIGS. 2A and 2B and uses a number of LEDs and LCDs. The key 507 corresponds to each of the keys shown in FIGS. 2A and 2B. Which key was depressed can be detected by a well-known key matrix.

Figure 4:
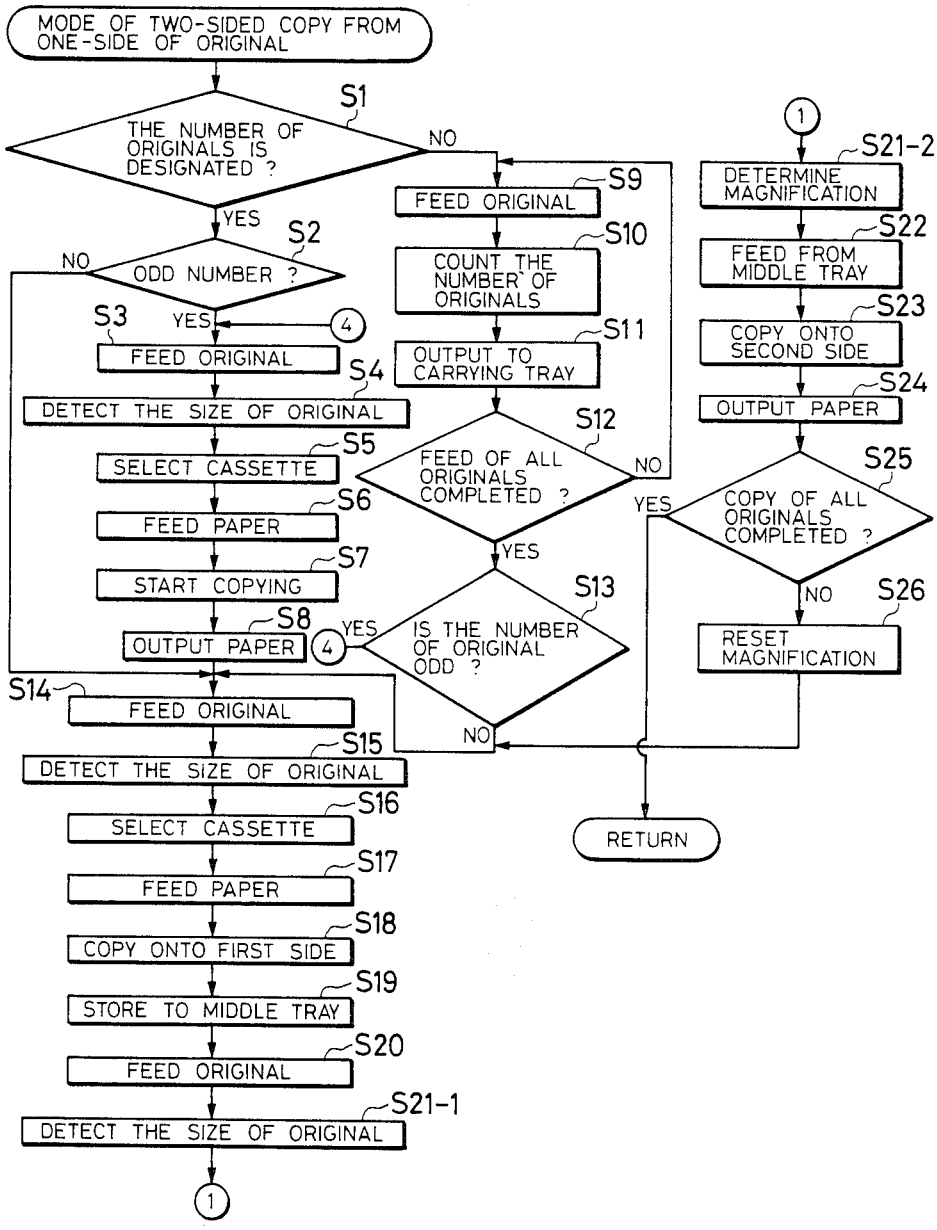
FIG. 4 is a control flowchart showing an example of the operation to obtain the two-sided copy from one-side of original.

An example of the operation of the foregoing copying apparatus will now be described. This apparatus has means for preliminarily inputting the data concerned with whether the number of originals is an odd number or an even number. The data is input by use of the ten-key 112 and asterisk mode setting key 113 of the operating section shown in FIGS. 2A and 2B. Namely, for example, by pressing the keys [*] [3] [1] [*], it is discriminated by the CPU and the mode is latched into the RAM. In this case, [*] [3] [0] [*] denotes the mode to designate that the number of originals is the even number. [*] [3] [1] [*] represents the mode to designate that the number of originals is the odd number. When the even-number original mode was designated, the odd-number original mode is automatically cancelled. Contrarily, when the odd-number original mode was designated, the even-number original mode is automatically cancelled. Thus, in the mode to form the two-sided copy from one-side of original, the counting operation of the number of orginals using the RDF 300 can be omitted. In addition, by cancelling this mode, the counting operation of the number of originals can be also performed as necessary. In this case, this mode is cancelled by pressing the keys of [*] [3] [1] [C] in the case of the odd-number original mode or [*] [3] [0] [C] in the case of the even-number original mode. This mode can be also cancelled by pressing the all reset key 116. It is also possible to obtain the two-sided copy from the originals of different sizes. FIG. 4 is a control flowchart for the operation mentioned above.

First, a check is made to see if the number of originals has been designated or not with respect to whether it is an odd number or an even number (step 1). If YES, the counting operation of the number of originals is omitted and a check is made to see if the odd number has been designated or not (step 2). If YES in step 2, the last page of the original put on the carrying tray 301 is fed (step 3). The size of original is detected by the sensor 302 (303) provided in the RDF 300 (step 4). The cassette in which the optimum copy papers are enclosed is selected on the basis of the detected original size and the set copy magnification (step 5). The optimum copy paper is fed (step 6). Only the one-sided copy is started (step 7). After completion of the copy, the copied paper is output to the outside of the apparatus (step 8). Thus, only the last page is the one-sided copy and it is prevented that the first page is combined with the blank page. If the odd number or even number is not designated, the originals put on the carrying tray 301 are fed one by one from the bottom, the number of originals is counted, and the originals are again output so as to be put onto the carrying tray (steps 9 to 11). These processes are repeated until all of the originals are fed (step 12). After they were completely fed, a check is made to see if the counted number of originals is the odd number or not (step 13). If YES, the processes of steps 3 to 18 are executed to obtain the one-sided copy of only the last page.

If the number of originals is the even number, or if the even-number original mode is designated, the original is taken out of the carrying tray and fed, the size of original is detected to select the optimum cassette, the proper copy paper is fed, the first side is copied, and the copied paper is stored to the middle tray (steps 14 to 19). The original to be copied onto the second side is fed, the size of original is detected, the optimum copy magnification is determined on the basis of the size of copy paper in which the first side was copied and the size of original, the lens is moved, the copy paper is taken out of the middle tray and fed, the second side is copied, and the copied paper is output to the outside of the apparatus (steps 20-1 to 24). A check is then made to see if all of originals have completely been copied or not (step 25). If NO, the copy magnification is reset to that of the first side (step 26) and the remaining originals are copied.

In the above description, the automatic paper selecting function (APS) operates for the first side of the two-sided copy, while the automatic magnification selecting function (AMS) operates for the second side. This mode is set by pressing the keys of [*] [3] [2] [*]. Since this mode can be set as necessary, when this mode is not set, the two-sided copy is executed on the basis of the magnification and cassette which have been first selected.

The above method can be also applied to the overlay copy mode.

The APS mode when the RDF is used will now be described. In this apparatus, the APS can effectively operate for both of the cases where the originals having different sizes were mixedly set and where the only originals having the same sizes were set. Namely, when the originals of various sizes were mixedly set, the sizes of originals are detected one by one. However, when the sizes of originals are the same, the size of only the first original is detected. When the APS mode was merely designated, the apparatus is set to the latter mode. However, the mixed size mode can be set by pressing the keys [*] [3] [3] [*].

Figure 5:
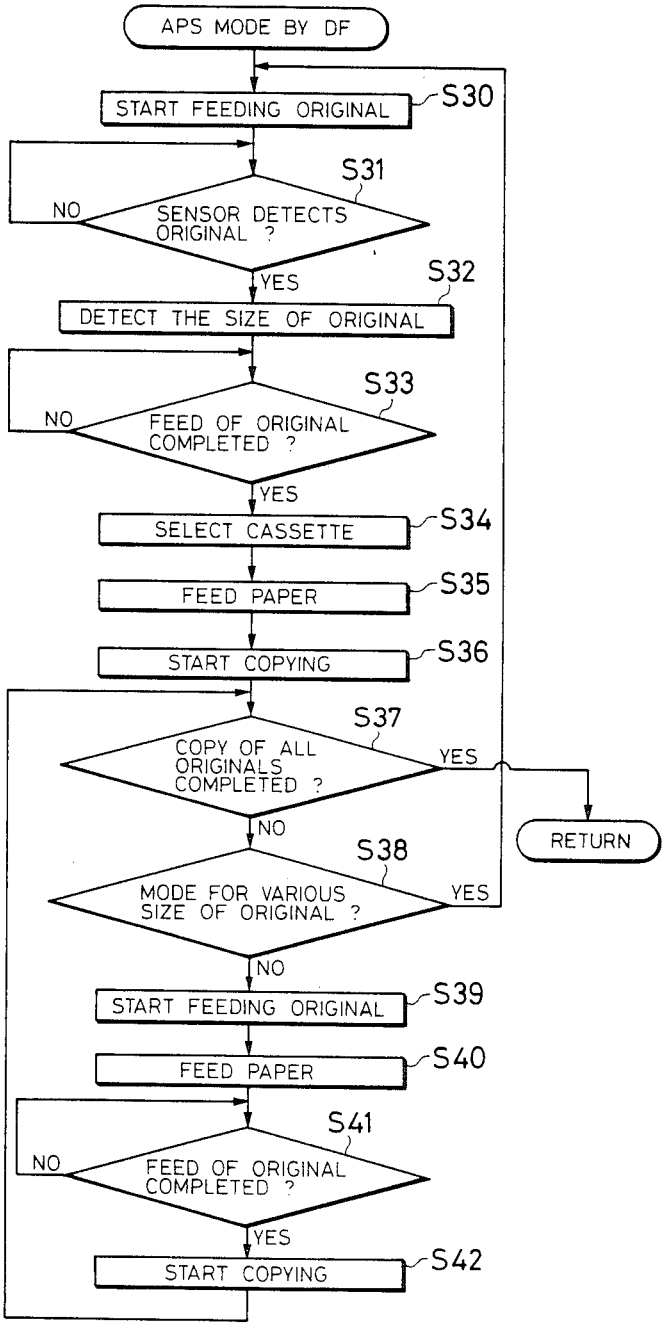
FIG. 5 is a control flowchart showing the automatic paper selecting function when an original feeding apparatus is used.

FIG. 5 is a control flowchart for the APS mode when the RDF is used. First, the copy start key is pressed and if the APS mode has been set, one original is fed (step 30). When the original is detected by the sensor 302, the size (width, length) of original is detected and this size is held until the next size is detected (steps 31 and 32). After the original has completely been fed, the cassette in which the optimum copy papers were enclosed is selected on the basis of the copy magnification and original size, the proper copy paper is fed, and the copy is performed (steps 33 to 36). A check is then made to see if all of the originals have completely been copied or not (step 37). If some uncopied originals are still left on the carrying tray, a check is made to see if the mixed size mode has been set or not (step 38). If YES, the processes are again repeated from step 30. If NO, the next one original is fed, the copy paper of the size previously held is fed, the original is fed and thereafter, the copy is performed (steps 39 to 42). The processes are again repeated from step 37.

The above method can be also applied to the case in the AMS mode.

An explanation will now be made with respect to the multicopy in the case of using the middle tray 59 such as in the two-sided copy mode, overlay copy mode, and the like. For example, the maximum number of papers which can be enclosed to the middle tray 59 assumes ninty-nine. If fifty originals are set to the RDF in the two-sided copy mode from one-side of original and the number of copies is 120, this number exceeds the maximum number of papers in the middle tray 59 by twenty-one since the number of copies is 120. Therefore, the first one of the originals put on the RDF is fed and the first side of each of the 99 papers is copied and the copied papers are stored to the middle tray 59. Next, the first original is output to the carrying tray 301 and the second original is fed. The copy papers are fed from the middle tray 59 and the second side of each of the 99 copy papers is copied. Thereafter, the copied papers are output to the outside of the apparatus. Next, the original is recirculated by the RDF 300 so that the first original can be fed. The first original is again fed and the first side of each of the remaining 21 copy papers is copied. Then, the copied papers are stored to the middle tray 59. The second original is fed and the second side of each of the 21 copy papers is copied. Thus, 120 copies can be derived. With respect to the third and the subsequent originals, the processes similar to the above are also executed and the copying operation is finished. Consequently, every 120 copy papers of twenty-five two-sided copies can be obtained.

Figure 6:
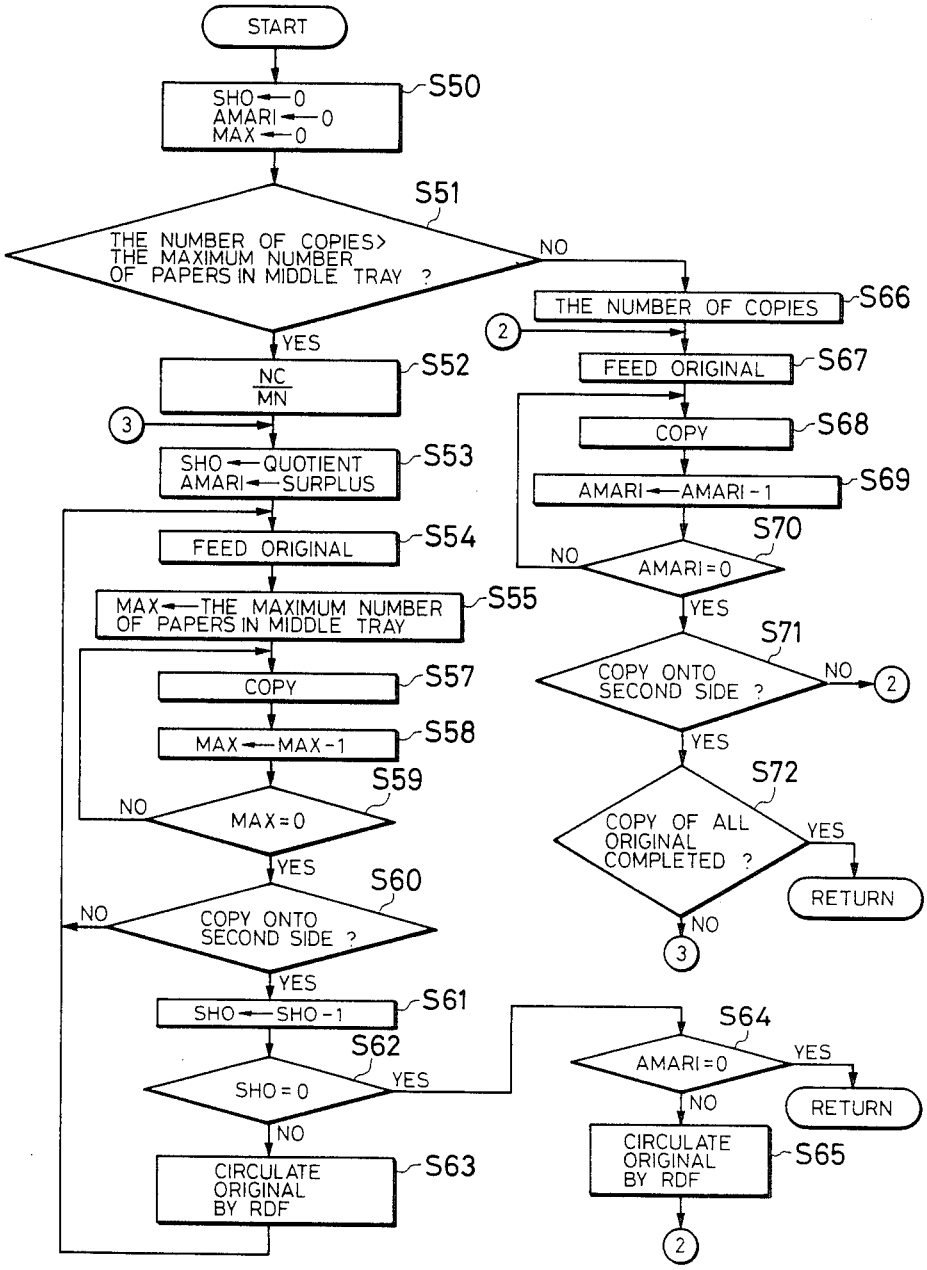
FIG. 6 is a control flowchart for the multicopy when a middle tray is used.
Figure 7:
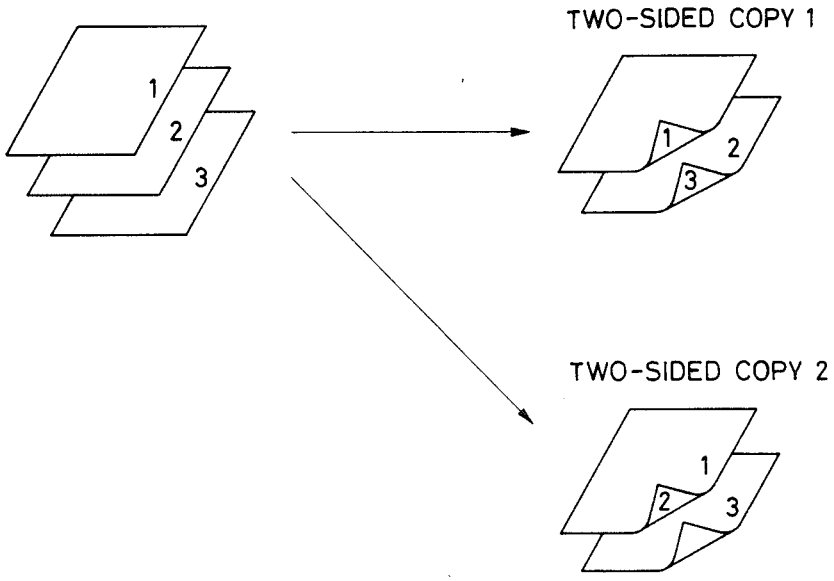
FIG. 7 is a diagram showing an example of production of the two-sided copy.

FIG. 6 shows a control flowchart for the foregoing operation. First, three variables (SHO, AMARI, MAX) are reset to 0 (step 50). The set number of copies is compared with the maximum number of papers in the middle tray (step 51). If the number of copies is larger, the quotient and remainder of [number of copies (NC)÷maximum number of papers in the middle tray (MN)] are calculated (step 52). The quotient is substituted for the variable SHO and the remainder is substituted for the variable AMARI (step 53). One original is fed (step 54). The maximum number of papers in the middle tray is substituted for the variable MAX (step 55). The first side of paper is copied (step 57). The value of the variable MAX is decreased by one (step 58). A check is then made to see if the variable MAX is 0, namely, if the papers of the number which is equal to the maximum number of papers in the middle tray have been copied or not (step 59).

If MAX≠0, the copy is repeated. If MAX=0, a check is made to see if the copy which has been performed now is the copy of the second side or not (step 60). If NO, the next original is fed and the processes are repeated from step 54 in order to copy the second side. If YES, the value of the variable SHO is decreased by one (step 61). A check is then made to see if the value of SHO is 0, namely, if the number of remaining copies is larger than the maximum number of papers in the middle tray or not (step 62). If SHO≠0, the original is recirculated by the RDF until the original from which the first side was coped can be fed (step 63). The processes are again repeated from step 54 in order to copy the remaining papers. If SHO32 0, a check is made to see if the value of the variable AMARI is 0, namely, if the remaining copies still exist or not (step 64). If AMARI≠0, the origial is recirculated by the RDF until the original in which the first side was copied can be fed (step 65). Then, step 68 follows. If the number of copies is smaller than the maximum number of papers in the middle tray in step 51, the number of copies is substituted for the variable AMARI (step 66). One sheet of original is fed (step 67). The copy is performed (step 68). The variable AMARI is decreased by one (step 69). A check is made to see if the value of the variable AMARI is 0, namely, if the copies of the necessary number have been completed or not (step 70). If AMARI≠0, the copy is repeated. If AMARI=0, a check is made to see if the copy which has been performed right now is the second side copy or not (step 71). If the copy is not the second-side copy, the next original is fed and the processes are repeated from step 67 in order to copy the second side. If the copy is the second-side copy, a check is made to see if all of the originals have been copied or not (step 72). If NO, the processes are repeated from step 53 in order to make the two-sided copy of the next page. In this manner, the two-sided copies in excess of the number of papers which can be stored in the middle tray can be derived.

In addition to the foregoing method, it is also possible to perform the two-sided copy with respect to all of the originals as many as the maximum number of papers in the middle tray and to subsequently execute again the two-sided copies of the remaining number with respect to all of the originals.

The above method can be also applied to the case of the overlay copy.

In addition, the invention can be also applied to a printer having the middle tray and the like as well as the copying apparatus. In this case, the output sequence of the images which are output from the image files and the like may be controlled.

The present invention is not limited to the foregoing embodiments but many modifications and variations are possible within the spirit and scope of the appended claims of the invention.

What we claim is:

1. An image forming apparatus comprising:

means for forming images onto one sheet a plurality of times, in which said image forming means has means for temporarily enclosing the sheet on which the images are formed and further forms images onto the sheet enclosed in said enclosing means;

means for setting the number of sheets to be formed with images; and means which, in the case where the number of sheets which is set by said setting means is larger than the number of sheets which can be enclosed into said enclosing means, controls said image forming means in order to divide the images into the images as many as the number of image forming times below said number of sheets which can be enclosed and to form the images.

2. An image forming apparatus according to claim 1, wherein said image forming means includes means for forming images onto the second side of said sheet after the images were formed onto the first side of the sheet.

3. An image forming apparatus according to claim 1, wherein said image forming means includes means for forming the images onto the first side of said sheet after the images were formed onto the first side of the sheet.

4. An image forming apparatus according to claim 1, further having means which can repeatedly feed the same original to the exposing surface, and wherein said control means allows said feeding means to again feed said original to said exposing surface for every divided image forming operation.

5. An image forming apparatus comprising:

means for forming images onto one sheet a plurality of times;

automatic sheet selecting means for selecting the sheet of the proper size on the basis of a size of image and an image forming magnification;

automatic magnification selecting means for selecting the proper image forming magnification on the basis of the size of image and the size of sheet; and control means for making said automatic sheet selecting means operative when the first image forming operation is performed by said image forming means and for making said automatic magnification selecting means operative when the second image forming operation is performed.

6. An image forming apparatus according to claim 5, wherein said image forming means includes means for forming images onto the second side of said sheet after the image were formed onto the first side of the sheet.

7. An image forming apparatus according to claim 5, wherein said image forming means includes means for forming the images onto the first side of said sheet after the images were formed onto the first side of the sheet.

8. An image forming apparatus comprising:

feeding means for feeding an original to an exposing surface;

means for automatically setting image forming conditions in accordance with the size of the original; and means which, in the case where a plurality of originals are sequentially fed by said feeding means, selects either one of the first mode to make said automatic setting means operative each time said original is fed and the second mode to make the automatic setting means operative only when the first original is fed.

9. An image forming apparatus according to claim 8, wherein said automatic setting means includes automatic sheet selecting means for selecting the sheet of a proper size in accordance with the size of the original and the image forming magnification.

10. An image forming apparatus according to claim 8, wherein said automatic setting means includes automatic magnification selecting means for selecting a proper image forming magnification in accordance with the size of the original and the size of the sheet.

11. An image forming apparatus according to claim 8, wherein in the case where said second mode is selected, the images are formed for the second and the subsequent originals on the basis of said image forming conditions which were set for said first original.

12. An image forming apparatus comprising:

means which can repetitively feed the same original to an exposing surface;

means which forms images onto a sheet and thereafter further forms images onto the same sheet as said sheet;

means for setting whether the number of originals set in said feeding means is an odd number or an even number;

means for feeding the originals set in the feeding means and for counting the number of originals; and means which, in the case of making said image forming means operative, controls the execution of the counting operation of said counting means in accordance with whether the odd number or even number has been set by said setting means or not.

13. An image forming apparatus according to claim 12, wherein said control means inhibits the execution of the counting operation of said counting means when the odd number or even number was set by said setting means, while said control means allows the counting operation by said counting means to be executed when the odd number or even number is not set by the setting means.

14. An image forming apparatus according to claim 12, wherein said image forming means includes means for forming images onto the second side of said sheet after the images where formed onto the first side of the sheet.

15. An image forming apparatus according to claim 12, wherein said image forming means includes means for forming the image onto the first side of said sheet after the images were formed onto the first side of the sheet.

* * * * *